United States Patent [19]

Cox et al.

[11] 4,194,100

[45] Mar. 18, 1980

[54] CIRCUIT BREAKER ENCLOSURE

[75] Inventors: Russell Cox, Frankfort; Joseph C. Drilling; Harris I. Stanback, both of Lexington, all of Ky.

[73] Assignee: Square D Company, Palatine, Ill.

[21] Appl. No.: 834,219

[22] Filed: Sep. 19, 1977

[51] Int. Cl.[2] ..... H01H 9/22; H01H 9/20

[52] U.S. Cl. ..... 200/50 A; 220/326; 220/366

[58] Field of Search ..... 220/315, 316, 326, 318, 220/344, 366, 331; 200/50 A, 50 AA, 50 AX, 153 R, 333; 74/97

[56] References Cited

U.S. PATENT DOCUMENTS

| | | | |
|---|---|---|---|
| 3,609,261 | 9/1971 | Rys | 200/50 A |
| 3,768,321 | 10/1973 | Cox | 200/50 A |
| 3,777,084 | 12/1973 | Rys | 200/50 A |
| 3,911,235 | 10/1975 | Venzke et al. | 200/50 A |
| 4,104,491 | 8/1978 | Dulle | 200/50 A |
| 4,107,488 | 8/1978 | Keller et al. | 200/50 A |
| 4,109,819 | 8/1978 | Kushman et al. | 220/326 |

*Primary Examiner*—George T. Hall

*Attorney, Agent, or Firm*—Larry I. Golden; Richard T. Guttman; Norton Lesser

[57] ABSTRACT

The following specification describes a circuit breaker enclosure having a cover, which is latched closed by spring biased latch handles. The handles and cover move in response to gas pressure for relieving the pressure generated on tripping of the circuit breaker. The latch handles are arranged to point outwardly of the enclosure, when open, to provide a clear visual indication of their being open. The circuit breaker handle and enclosure handle are directly engaged with a common pivot pin for synchronous movement to enable the enclosure handle to indicate the trip condition of the breaker. When the cover is open, the handles are interlocked against movement to an ON position by a biased pivotable interlock plate. The cover in turn is latched closed through the interlock plate and a breaker handle plate, when the circuit breaker enclosure handles are in the ON position. A pair of spaced edge projections on the enclosure wall engage the cover sealing gasket to avoid a permanent compression set in the gasket.

40 Claims, 10 Drawing Figures

64
62
69
66
70
48
10
60
59
44
38
55
16
68
56
52
58
42
30
40
46
54
24
72
74
76

CIRCUIT BREAKER ENCLOSURE

FIELD OF THE INVENTION

This application relates in general to an enclosure for use with a circuit interrupting device and more particularly to an improved and more economical circuit interrupting device enclosure.

SUMMARY OF THE PRIOR ART

Circuit interrupting devices such as circuit breakers or switches are often enclosed in an individual metal box or enclosure having an enclosure handle interconnected with the circuit breaker handle or switch for operating the same. A cover movable between an open and closed position provides access to the breaker or switch and is latched closed when the enclosure handle is operated to the ON position to close the breaker or switch contacts. The cover is latched closed in order to protect personnel from inadvertently entering the enclosure without operating the enclosure handle to the OFF position for opening the contacts of the circuit breaker or switch.

An interlock assembly is of course also provided to prevent operation of the exterior or enclosure handle to the ON position unless the cover is first closed.

An example of such an enclosure for use with a switch is shown in U.S. Pat. Nos. 3,777,084 and 3,768,321 and an example of an enclosure for use with a circuit breaker is shown in U.S. Pat. No. 3,911,230. The interconnection between the enclosure and latch handles of a switch enclosure and the interlock assembly therefor are relatively complicated, but simpler then that used for a circuit breaker enclosure, since the circuit breaker usually has additional functions.

In the usual circuit breaker enclosure the enclosure handle in the ON position may be used to latch the enclosure cover closed and therefore when the circuit breaker handle is moved to a trip position in response to a fault current for opening the circuit breaker contacts, the enclosure handle is retained in the ON position. The circuit breaker handle must then be operated through an OFF position to the reset position before the contacts can be again closed.

In addition a defeater assembly is usually provided to enable entrance by authorized personnel to the enclosure with the circuit breaker handle in the ON position. A complicated and expensive link arrangement for connecting the enclosure handle to the circuit breaker or switch is therefore usually required or the enclosure may be opened too easily.

To indicate the trip position of the circuit breaker, a relatively small indicator or flag may be operated by the breaker handle as it moves to the trip position, while the exterior handle, as mentioned, is usually retained in the ON position. This does not provide a clearly visible indication of the tripped condition of the circuit breaker.

Furthermore the pressure of hot ionized gases escaping from the circuit breaker during circuit interruption, as a result of a fault current tripping the breaker, can blow off or damage the cover or associated apparatus, since the pressure may reach values as high as 30 psi.

To meet certain electrical standards and requirements such as set forth for NEMA12 enclosures a sealing gasket is also provided on the cover for sealing the enclosure against the entrance of impurities such as dust or moisture and since relatively heavy pressure can be applied to the gasket to seal the same, the gasket may receive a permanent set rendering it ineffective.

SUMMARY OF THE INVENTION

The present invention provides a simplified and economical circuit breaker enclosure in which the enclosure handle is pivotally mounted in a side wall of the enclosure and the circuit breaker handle is secured by a unitary breaker handle plate to the enclosure handle pivot pin so that each handle moves in response to the movement of the other to each of the circuit breaker positions. A simple biased interlock plate engages the breaker handle plate to prevent movement of the handles to the ON position unless the cover is closed. The interlock plate in turn is pivoted from the handle plate on closure of the cover for enabling handle movement and for movement into the path of a latch element on the cover. On movement of the handles to the ON position, the breaker plate is in the path of the interlock plate to normally prevent movement of the latch element past the interlock plate and maintain the cover latched closed with some play.

A simple defeater arrangement is provided by an externally extended pivot for the interlock plate to permit the cover to be unlatched by simply pressing the cover in a direction to reduce the play and enable rotation of the interlock plate to a position from the path of the cover latch element. The cover may then be opened with the handles in the ON position.

Since the circuit breaker handle and the enclosure handle move together, the movement of the circuit breaker handle to the trip position moves the elongate enclosure handle to a similar position. The enclosure handle clearly indicates the tripped condition of the circuit breaker.

To reset the spring toggle assembly of the circuit breaker, after it is in the trip condition both handles must be moved through the OFF position to a reset position. A stop movable relative the enclosure handle may then be engaged with an enclosure slot and the handle may be latched to the enclosure to require positive release thereof, before the circuit breaker can be placed in the ON condition.

In order to prevent the cover from blowing off or being damaged, a pair of spring biased cover latch assemblies are provided for holding the cover sealing gasket tightly engaged with the walls of the enclosure and additionally latching the cover, while permitting excess gas pressure to be vented by yielding to vent the excess pressure. The latch assemblies thus ensure sealing engagement between the gasket and enclosure wall as required for NEMA 12 enclosures.

Each cover latch assembly includes a latch handle pivotally supported adjacent one end of the latch handle on a pin, which is received in a pair of slots formed in a bracket secured to the enclosure wall. Each handle and pin are biased toward one end of the respective slots, and a lip at the other end of the latch handle is adapted to engage a lip on the cover, when the latch handle and pin are raised against the bias toward the other slot ends to additionally latch the cover closed. The cover is restrained by the bias of the latch assemblies and may move against the bias in response to gas pressure generated on tripping the breaker to vent or relieve the pressure before damage occurs.

After the latch lip is disengaged from the cover lip by raising the latch handles, the spring bias moves the latch handle toward the one end of the slots. Since the spring force is somewhat eccentric to the pin axis the lip end of each latch handle pivots outwardly from the enclosure to clearly indicate the open condition of the latch assembly.

A pair of edge projections on the end edge of the enclosure wall engage the sealing gasket at positions coincident with the latch assemblies and provide local areas of penetration into the sealing gasket for enabling the cover to be held closed under a selected pressure and to prevent the gasket from assuming compression set along the edge.

It is therefore one object of the present invention to provide an improved and more economical circuit interrupting device enclosure or assembly.

It is another object of the present invention to provide an improved and more economical handle or interlock assembly for use in a circuit breaker enclosure.

It is another object of the present invention to provide an improved and more economical defeater assembly for a circuit breaker enclosure.

Another object of the present invention is the provision of improved economical means for indicating the trip condition of a circuit breaker in an enclosure.

Still another object of the present invention is the provision of improved economical means for preventing damage to a circuit breaker enclosure in the event of a fault condition.

Yet another object of the present invention is the provision of improved economical means for protecting the sealing gasket of an enclosure cover.

Other objects and features of the present invention will become apparent on examination of the following specification and claims together with the drawings.

DESCRIPTION OF PREFERRED EMBODIMENT

Figure 1:
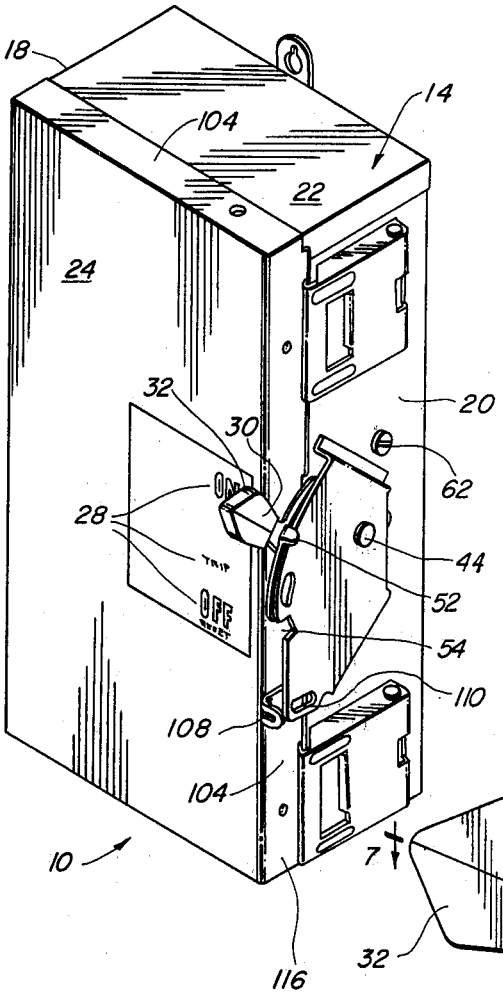
FIG. 1 is an isometric view of a circuit breaker enclosure incorporating the principles of the present invention.
Figure 2:
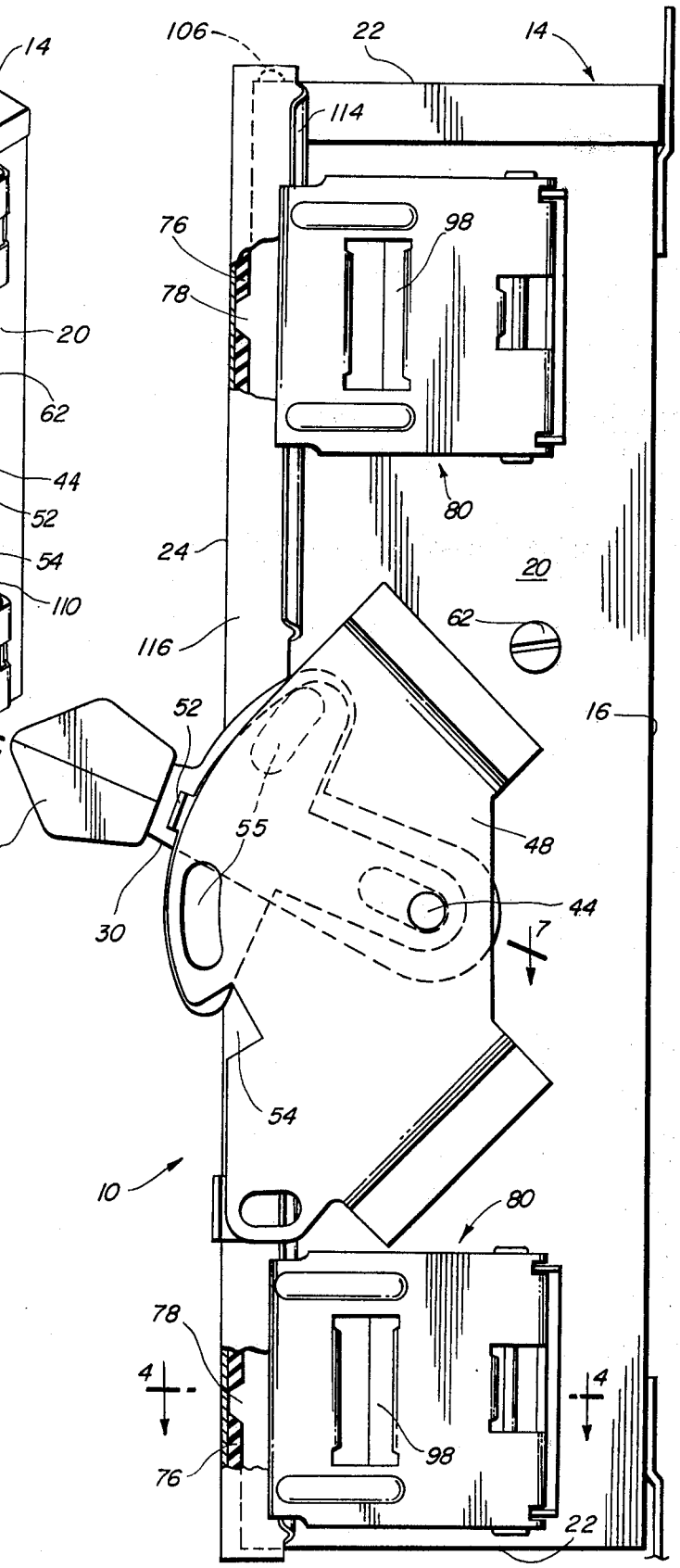
FIG. 2 is a side elevational view of the circuit breaker enclosure shown in FIG. 1.
Figure 3:
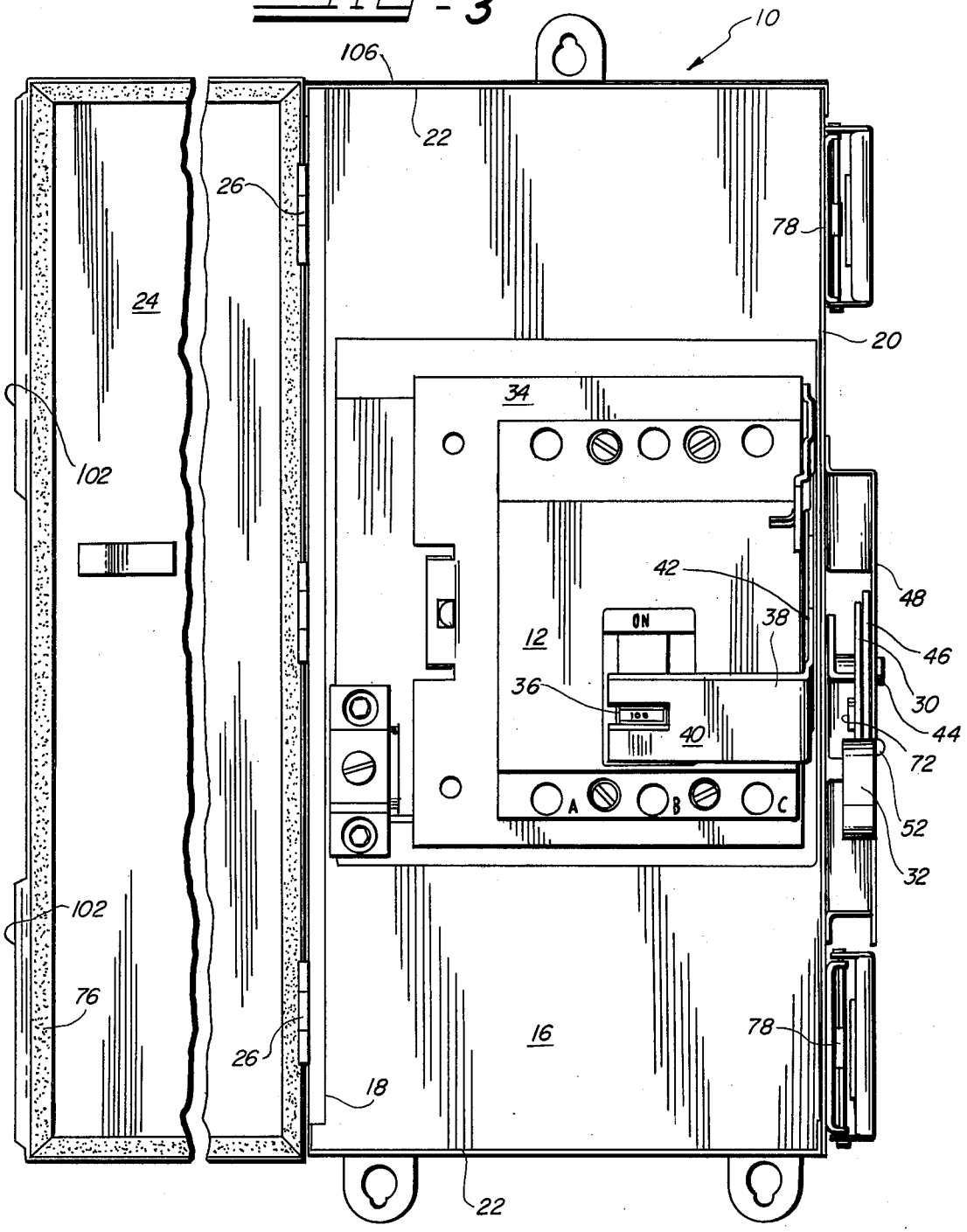
FIG. 3 is a front elevational view of the circuit breaker enclosure shown in FIG. 1 with the cover in open position.

In FIGS. 1–3 an enclosure indicated generally by the reference character 10 is shown for enclosing a circuit breaker indicated by the reference character 12 in FIG. 3.

The enclosure 10 includes a metal box 14 adapted to be attached usually to a suitable vertical support and defined by a back wall 16, having projecting side walls 18 and 20 together with projecting top and bottom walls 22 forming a frame or peripheral wall. The enclosure 12 is adapted to be closed by a metal cover or door 24 secured to wall 18 by hinges 26 and bearing suitable external indicia 28 having marks ON, TRIP OFF and Reset for indicating the condition or position of the circuit breaker in accordance with the position of a handle 30. Handle 30 has suitable grip 32 having differently colored marks or indicia. The indicia on grip 32 are divided into a red portion and a black portion separated longitudinally at the juncture of the two grip halves with each portion positioned in a prominently visible position in accordance with the ON, OFF or Reset position respectively of the handle and substantially equally visible when the elongate handle axis is aligned with the mark TRIP or indicia 28.

The circuit breaker 12 may be used to interrupt 3 phase currents of 14,000 R.M.S. amps at 480 volts AC or 18,000 R.M.S. amps at 240 volts AC, for example, and is detachably secured to a plate held by the back wall 16 of the enclosure with an insulating member 34 therebetween. A leg on member 34 extends between the breaker and side wall 20. A neutral assembly is secured to the wall 16 adjacent the side wall 18 and a connection between a source and a load is extended through a wall of the enclosure to the circuit breaker.

The breaker 12 is provided with a handle 36 extending through the top wall of the breaker 12. The handle 36 is manually movable from an OFF or a Reset position to an ON position by handle 30, when the cover 24 is closed, for closing a pair of contacts carried in the breaker for each phase. Handles 30 and 36 are movable to a TRIP position by the breaker spring toggle assembly either as result of the breaker tripping under an overload or fault current to open the breaker contacts or by manual operation of a button extending through the breaker housing. When the breaker 12 is in the trip condition the conventional toggle spring assembly acts to snap the contacts open and move the handle 36 to a trip position intermediate the ON and OFF positions. The toggle assembly must be reset to enable the contacts to again close. To reset the toggle spring assembly, the handle 30 must first be operated through the OFF position to the Reset position. Then to close the contacts the handle must be operated to the ON position. The handles 30 and 36 may of course also be directly operated between the On and OFF positions to simply open and close contacts, but if the circuit breaker should be in the trip condition the handle 36 must be operated to the reset position before the contacts can be reclosed.

Figure 7:
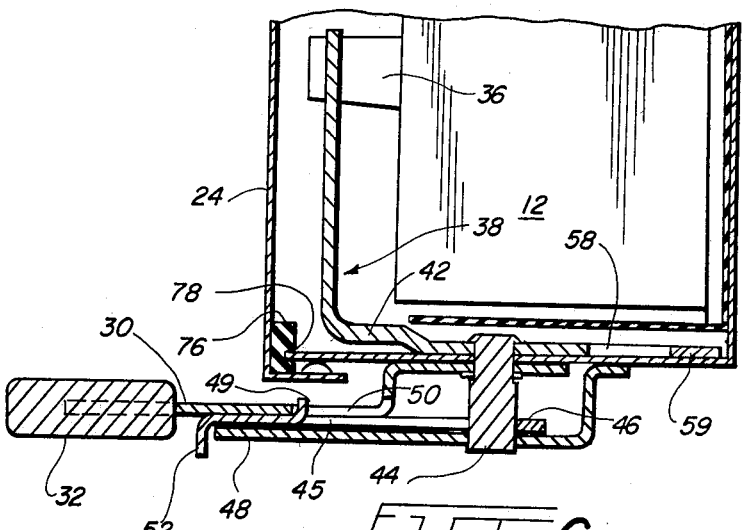
FIG. 7 is a sectional view taken generally through the line 7—7 in FIG. 2.
Figure 6:
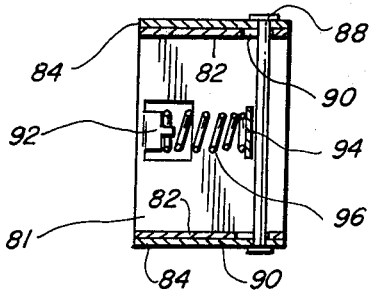
FIG. 6 is a sectional view taken through the line 6—6 in FIG. 4.

To enable handle 30 to move synchronously with handle 36, an L shaped breaker handle plate 38 is provided as best seen in FIG. 7. An end slot in one leg 40 of a breaker handle plate 38 detachably receives the circuit breaker handle 30 and the other leg 42 of breaker plate 38 extends along the inner surface of wall 20 and is fixed to a pivot pin 44 passing through wall 20 to detachably secure the handle 36 to pin 44.

Pin 44 is fixed to an offset portion of handle 30 adjacent the exterior surface of wall 20 and passes through both an elongate slot 45 in a lock plate 46 and pivotally through a support bracket 48. Bracket 48 is secured by end legs to the external surface of wall 20. Thus the handles 30, and 36 are secured to pin 44 to move together or in synchronism.

The lock plate 46 has a tang 49 seated in an elongate slot 50 in handle 30 and parallel to slot 45 so that the plate 46 is required to pivot with the handle 30, but may move along the elongate axis of handle 30. Movement of lock plate 46 enables a tang or stop 52 thereon to engage in a slot 54 which forms a stop in bracket 48 when handle 30 is in the reset position to require a positive release. In addition aligned passages 55 are provided in handle 36 and bracket 48, when stop 52 is in slot 54 to enable the handles 36 to be padlocked or secured in the reset position. Stop 52 normally engages the top arcuate free edge of bracket 48 to hold the tang 49 at the upper end of slot 50.

Figures 8, 9, 10:
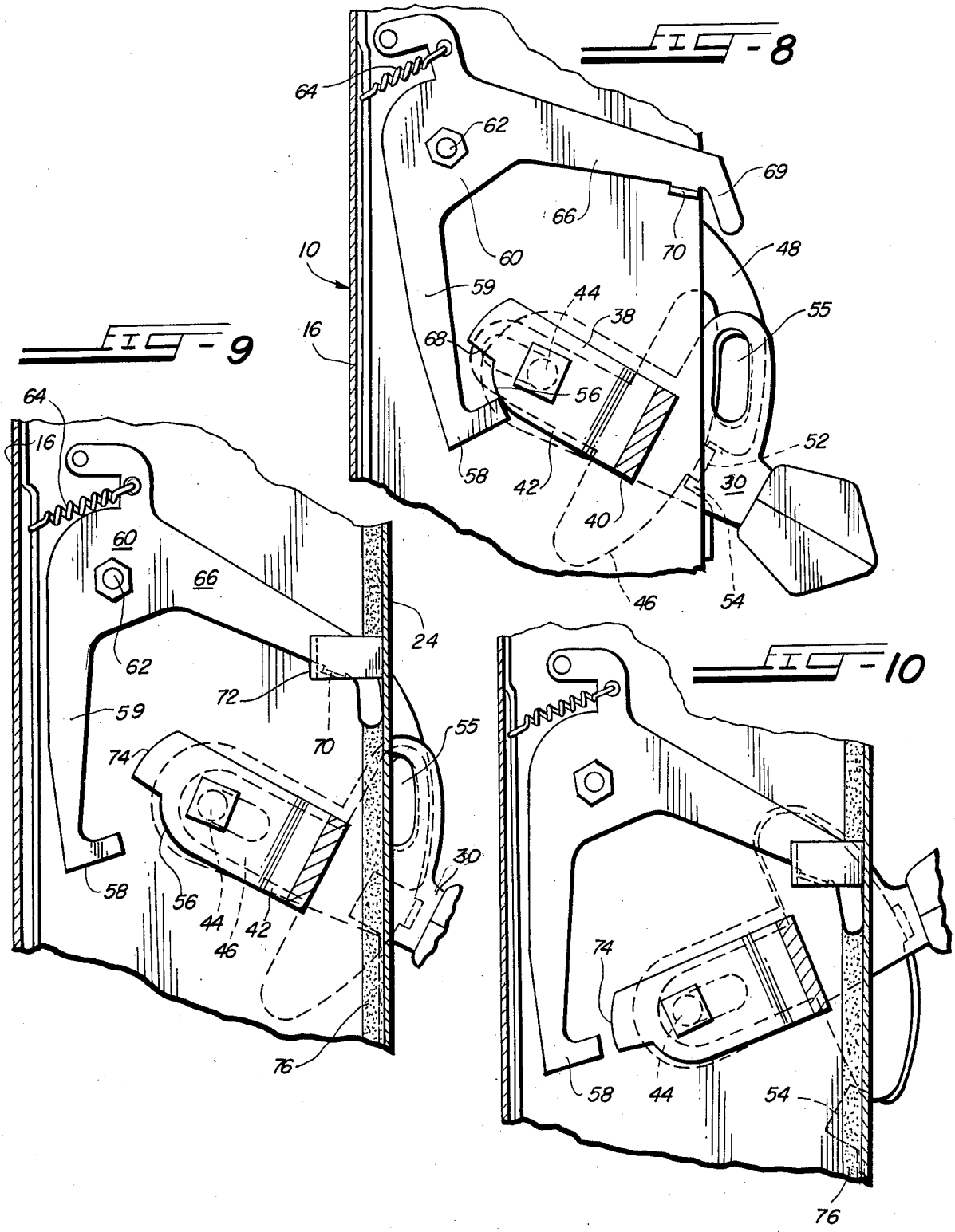
FIG. 8 is a fragmentary sectional view illustrating the position of the lock plate and interlock plate for preventing handle operation, when the cover is open.
FIG. 9 is a fragmentary sectional view illustrating the position of the interlock plate in response to cover closure.
FIG. 10 is a fragmentary sectional view illustrating the handle in the ON position and the position of the interlock plate when the cover is latched closed.

The leg 42 of the breaker handle plate 38 has an arcuate edge surface 56 engaged by the end surface of a tang 58 on one leg 59 of an L shaped generally planar interlock member or plate 60, when the cover 24 is open and the handle 30 is in the OFF or in the Reset position as best seen in FIG. 8. Interlock member 60 is pivotally mounted on wall 20 by a pin 62, which extends through wall 20 and is provided with a slotted end so that plate 60 is rotatable from the exterior of enclosure 10, if desired. Member or plate 60 is biased in a counterclockwise direction as seen in FIGS. 8–10 by a spring 64 secured between the enclosure and a projecting arm on member 60 to normally hold tang 58 engaged with leg 42. The other or vertical leg 66 of plate 60 extends parallel to wall 20 past the open end of the enclosure and has an offset angular arm 69 for engagement by cover 24 to rotate member 60 against the bias of spring 64.

The arcuate edge 46 of leg 42 permits pivotal movement of handle 30, as the arcuate edge portion 56 rides the top or radial edge of tang 58. The arcuate edge portion 56 terminates in a straight or radial edge portion 68 extending substantially radially from the axis of pin 44 so that the handle 30 cannot be rotated past the Trip position to the ON position in the event the cover is open, as the edge portion 68 then engages the portion of tang 58 transverse to a radial line from pin 62.

The other leg 66 of interlock plate 60, as noted, projects above wall 20 and is provided with a transverse or offset angular arm 69 engaged by cover 24 for pivoting tang 58 from the path of leg 42 on closure of the cover 24 as seen in FIGS. 9 and 10. Closure of cover 24 engages the arm 69 at a position offset from the axis of pin 62 to pivot member 60 clockwise, as seen in FIGS. 8, 9 and 10 and against the bias of spring 64. This moves tang 58 from a position interfering with the movement of plate 38 and permits movement of the handles 30 and 36 to the ON position for closing the circuit breaker contacts.

An arm or latch element 70 projecting from the general plane of member 60 is provided just below the offset arm 69 for selected engagement by one leg of a tang or latch element 72 depending from the internal surface of cover 24 to provide a defeater arrangement or assembly. When the cover 24 is closed the leg of latch element 72 moves past arm 70, and the cover then engages arm 69 to pivot plate 60 clockwise as seen in FIGS. 8–10. The latch element 70 then extends between the tang 72 and the cover, as shown in FIGS. 9 and 10 in an interfering relationship with tang 72. The cover is opened with the handle 30 in other than the ON position, as plate 60 and arm 70 can pivot counterclockwise to enable the latch element 72 to clear arm 70.

If however, the handle 30 is in the ON position as shown in FIG. 10, the bottom or end edge portion 74 of leg 42 is positioned in the arcuate path of tang 58 to prevent pivoting of arm 70 from the path of the tang or latch element 72. The latch element 72 therefore cannot move past arm 70 and the cover 24 is held latched closed in a first position while at the same time the arm 70 is prevented from rotation in a clockwise direction by tang 72 engaging a corner of arm 70. Thus without further closure movement of the cover to a second closed position the cover cannot be opened with the handles in the ON position.

The cover 24 may however be opened with the handles in the ON position, if an authorized person presses with one hand to close the cover more tightly against the pressure of a sealing gasket 76 to remove tang 72 from the path of clockwise rotation of latch element 70 and uses the other hand to manipulate the slotted end of pin 62, to rotate plate 60 further in a clockwise direction against the bias of spring 64. The plate 60 rotates toward back wall 16 and between the end edge of the plate carrying breaker 12 and side wall 20. The rotation of plate 60 removes arm 70 from the path of tang 72. The cover may then be opened and the pin 62 thereafter released. With the cover open access is provided to the enclosure with the circuit breaker in an ON condition.

Figure 4:
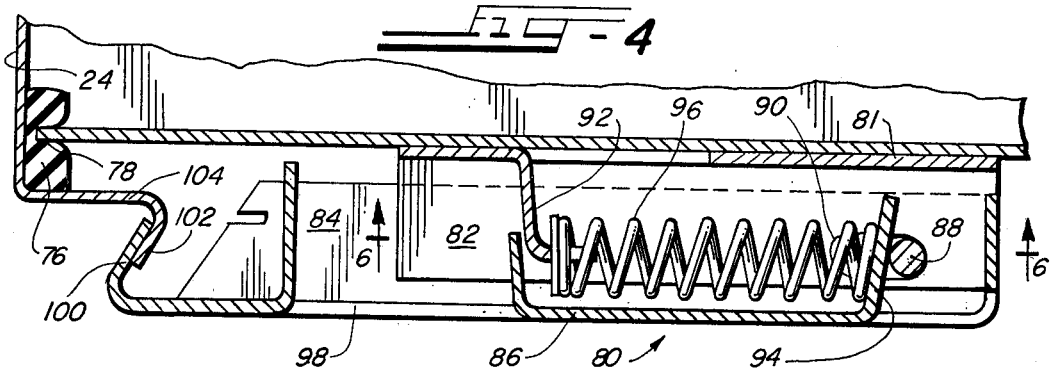
FIG. 4 is a sectional view taken generally through the line 4—4 of FIG. 2 to illustrate the latch assembly.
Figure 5:
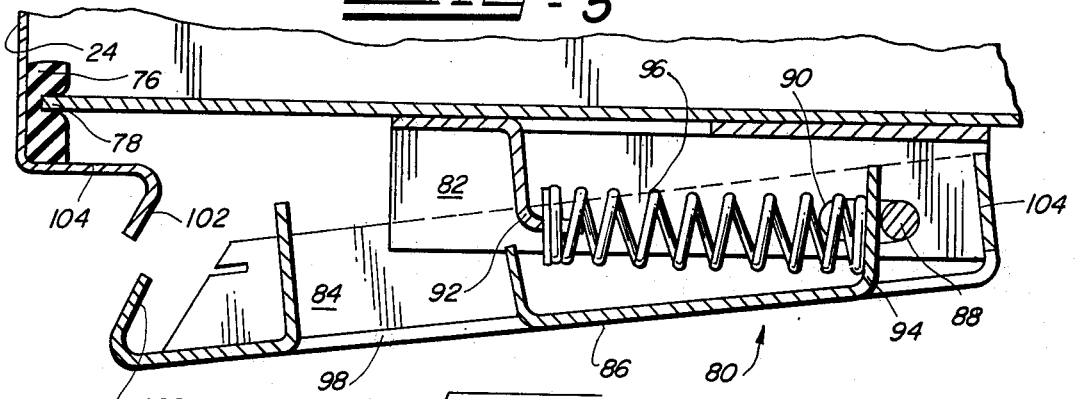
FIG. 5 is a sectional view similar to FIG. 4 but illustrating the latch assembly in open condition.

The sealing gasket 76 is formed of neoprene or similar material and extends about the cover edge for engaging the free edges of walls 18, 20 and 22. Wall 20 is provided with a pair of spaced projecting edge portions 78 which project outward approximately 3/16" and extend along the edge of the wall approximately 0.5" and which partially penetrate the gasket 76 as seen in FIGS. 4 and 5 to thereby compress local areas of the gasket to a selected value while enabling the remaining free edge portions of walls 18, 20 and 22 which are substantially 15"×18" to sealingly engage the gasket 74 under minimum deformation. Since the local areas accommodate a pressure dependent on the compression or penetration, they absorb a large portion of the closing pressure and counteract the pressure exerted by latch assemblies 80 on the gasket, when they latch the cover 24 closed. Thus the edge portions 78 act as stops to limit the compression of the remainder of the gasket and prevent the gasket 62 from taking a permanent compression set about its periphery, as this would reduce the effectiveness of the seal.

The latch assemblies 80 are provided at spaced positions on wall 20 with each position coincident with a respective one of edge portions 71. Each latch assembly 80 includes a U shaped mounting bracket 81 having a back leg fixed to the exterior surface of wall 20 and end legs 82 projecting from the wall 20 and nestingly received by the side legs 84 of a respective U shaped latch element or handle 86. A pivot pin 88 located above an inwardly bent finger grip leg of the handle extends through legs 84 and a slot 90 in each of the end legs 82 of bracket 81 to pivotally support the handle 86 at a position adjacent the back end of the handle 86 and bracket 81, while permitting relative longitudinal movement between the handle and bracket.

A tang 92 projects outwardly from the back leg of bracket 81 and a tang 94 projects inwardly from the back leg of handle 86 toward wall 20 and adjacent the pin 88. A coil or helical spring 96 mounted between the tangs 92 and 94 forces the handle 86 toward the lower or back end of slot 90 and applies a force eccentrically to the pin 88 for pivoting the free end of handle 86 outwardly from the wall 20 for clearly indicating the open condition of the latch handle 86. The side legs 82 of bracket 81 adjacent the lower end of the bracket and handle act as stops to limit the outward pivoting movement of the handle 86 and a finger grip portion 98 is formed in the back wall of the handle 86 by two facing inwardly bent legs intermediate the handle ends.

The free end of the latch handle 86 is provided with a lip 100 extending toward the wall 20 and partially bent back in the direction of the latch handle back leg to form a reverse bend at an angle of substantially 45°. The lip 100 is adapted to engage or overlap a complementary formed lip or flange 102 of the cover 24 formed at a corresponding position on the cover for interlocking the lips 100 and 102.

The lips 102 are actually formed at spaced positions on a flange wall 104 extending about the periphery of cover 24 to overlap the outer surface of walls 18, 20 and 22. Flange wall 104 may be provided with inwardly projecting detents or dimples and along the top wall 22 of the box a raised portion or bead 106 coextensive with the top wall serves to engage the overlapping flange 104 for preventing the entrance of rain or moisture.

With the handles 30 and 36 in either the OFF or Reset position, they cannot be operated to the ON position without closing the cover 24, as rotation of the handles counterclockwise as seen in the drawings toward the ON position engages the radial edge portion 68 of plate 38 with the transverse edge portion of tang 58 to prevent further handle rotation. Closure of the cover moves tang 72 past arm 70 and engages arm 69 to pivot the plate 60 clockwise about pin 62. This removes tang 58 from the path of plate 38 to permit pivoting of the handles and places arm or latch element 70 in interfering relationship with the path of the cover tang or cover latch element 72.

If the handle 30 is in the Reset position the stop 52 on the lock plate 46 may be positioned in the slot 54 and a lock also inserted through passages 55. In this event the stop 54 must be deliberately disengaged from slot 54 and the lock removed from passages 55 to permit rotation of the handle 30. The stop 54 is normally held against an edge of slot 54 by the spring pressure of the circuit breaker spring toggle assembly exerted through handle 36, plate 38, handle 30 and tang 49 in slot 50, and therefore positive effort is required to release the same.

The handle 30 rotates through an arc of substantially 22½° from the Reset position to the OFF position and then through an arc of substantially 12° from the OFF position to the TRIP position. As the handle 30 rotates through the TRIP position an arc of substantially 9° it enters the ON position extending through an arc of substantially 22° and the circuit breaker toggle spring assembly snaps the circuit breaker contacts closed. The end edge portion 74 of plate 38 now overlaps tang 58 to prevent rotation of latch element 70 from the path of tang 72 in the event an attempt is made to lift the cover. The cover may also be locked in the closed position by means passage 108 and 110 in the cover and bracket 48 respectively.

With the cover 24 closed, the latch handles 86 may each be operated against the bias of springs 96 to engage lips 100 with lips 102 and further latch the cover closed. This places the sealing gasket 76 under some pressure to seal the edges of walls 18, 20 and 22 while the edge portions 78 penetrate local areas of the gasket to limit the deformation of the other gasket portions. The opposite faces of edge portions 78 are engaged by the gasket as they penetrate the gasket.

To gain entrance to the enclosure 10, when the circuit breaker 12 is in the ON condition, the handle 30 is pivoted toward the OFF position to move the circuit breaker handle 36 in a corresponding direction. The latch handle lips 100 are also disengaged from cover lips 102. When handle 30 is pivoted to the TRIP position, OFF position or Reset position surface 74 is no longer in overlapping relationship to tang 58 and the cover 24 may be opened, since arm 70 can now pivot from the path latch element 72. The handles 30 and 36 cannot then be operated to the ON position until the cover is again closed since tang 58 of the interlock plate 60 is then engaged by surface 68 as explained above.

To gain entrance to the enclosure with the handle 30 in the ON position by operation of the defeater arrangement, the latch handles 86 are operated to release lips 100 from lips 102 and as mentioned pressure is applied in a closing direction to cover 24. This pressure moves latch element 72 from the path of rotation of arm 70. The pin 62 is also rotated by means of a screwdriver, for example, to move arm 59 toward the back wall 16 and arm 70 from the path of tang 72. While arm 70 is held in the rotated position the cover may be opened and the pin 62 then released. Access is now had to the enclosure for a desired purpose. The cover is closed with the handles in the ON position by simple closure as tang 72 simply pivots arm 70 in a clockwise direction to pass the arm 70 and then the arm 70 pivots back into an interfering relationship with tang 72.

If it is necessary to operate the breaker 12 to the ON position from one of the other positions with the cover 24 open, a screwdriver engaged with pin 62 pivots the interlock plate 60 clockwise to move tang 58 from the path of edge portion 68. This enables handle 30 to pivot to the ON position free of interference by tang 58.

If the circuit breaker should have been tripped by a fault current the pressure of gas expansion may lift the cover 24 as the springs 96 yield to allow the latch handles and cover to move with the latch handles 86 following the cover movement. This movement separates the gasket 76 from the edge of walls 18, 20 and 22 to relieve or vent the gas pressure.

When the circuit breaker 12 is tripped, the handles 36 and 30 of course move synchronously to the Trip position substantially midway between the ON and Reset position. The handle 30 together with the color indicia thereon are easily visible in this position and before the circuit breaker contacts can be reclosed the handle 30 must be operated to the Reset position and then to the ON position. In the ON position the red mark on the handle 30 is prominently displayed, while in the OFF or Reset position the black mark is prominently displayed.

The latch handles 86 may each be lifted against the bias of springs 96 until the lips 100 and 102 are clear of each other to open the latch handles 86. Springs 96 then simply retract the handles 86 by moving pin 88 downwardly or toward the back end of slot 90. With the latch handles 86 open, their lip ends pivot from the enclosure, so that if they should be left in the open condition, with the cover in approximately the closed position, that condition can be noted at a considerable distance and the condition of the breaker or switch noted to determine if the latch handles should be closed.

The foregoing description relates to a circuit interrupting device enclosure whose inventive concepts are believed set forth in the accompanying claims.

We claim:

1. An enclosure for a circuit interrupting device comprising:

a peripheral wall encircling said device, a cover carried by said wall for movement between an open and closed position, a sealing gasket carried by said cover for engaging an end edge of said wall in response to the movement of said cover to said closed position, a latch element, means carrying said latch element on said wall for pivotal and longitudinal movement relative said wall to enable said latch element to engage said cover for latching said cover in said closed position, and bias means for biasing said latch element longitudinally relative said wall for placing said gasket under pressure against said end edge in response to the latching of said cover in said closed position and for pivoting said latch element in response to the disengagement of said latch element from said cover for indicating an open position of said cover.

2. In the enclosure claimed in claim 1 a projection on said end wall for penetrating said gasket to limit the deformation of said gasket engaged with said end edge.

3. A circuit interrupting device enclosure having a peripheral wall for encircling a circuit interrupting device and having a cover pivotally carried by said wall for movement between a closed position and an open position; the improvement comrpising:

a sealing gasket carried by said cover for engagement with an end edge of said wall in response to the movement of said cover to a closed position, means for exerting a yieldable closing force on said cover in said closed position and for applying said force against said gasket, and a pair of spaced projections on said end edge for penetrating said gasket for a distance corresponding to said force for limiting the deformation of said gasket by said end edge.

4. In the improvement claimed in claim 3 in which said means exerting a yieldable closing force comprises:

a latch handle for each projection having a latch means for interlocking engagement with said cover to latch said cover in said closed position, means supporting said latch handle on said wall for pivotal and longitudinal movement relative said wall and relative said cover in said closed position for enabling said interlocking engagement and for enabling disengagement of said latch handle from said cover, and bias means for biasing said latch handle from said cover for exerting a yieldable closing force on said cover in response to said interlocking engagement for enabling said cover to move a selected distance toward said open position.

5. The enclosure claimed in claim 4 in which said device is a circuit breaker adapted to generate a high pressure gas in response to a fault current and the movement of said cover said selected distance enables the venting of said gas.

6. A circuit interrupting device enclosure having a peripheral wall encircling a circuit interrupting device adapted to supply a gas under relatively high pressure in response to a fault current applied to said device with said gas confined by a cover pivotally carried by said wall for movement between a closed position and an open position; the improvement comprising:

a gasket carried by said cover for engagement with the end edge of said wall in response to the movement of said cover to said closed position, means for exerting a yieldable closing force on said cover in said closed position for enabling said cover to move from said closed position toward an open position to separate said gasket from said end edge and enable the venting of said high pressure gas and for automatically returning said cover to said closed position in response to the reduction in pressure of said gas.

7. A circuit breaker enclosure including a peripheral wall encircling a circuit breaker adapted to be tripped in response to a fault current whereby a gas in said enclosure is subjected to relatively high pressure and is confined by said wall and a cover pivotally carried by said wall for movement between a closed position and an open position; the improvement comprising:

latch means engaged with said cover and wall to latch said cover in said closed position, and means enabling relative movement between said latch means and said wall and biasing said cover toward said closed position in response to the latching of said cover whereby a yieldable closing force is exerted on said cover in response to the latching of said cover for enabling said cover to pivot toward said open position for venting said high pressure gas with said latch means retaining said cover latched.

8. The enclosure claimed in claim 7 in which said latch means comprises a latch handle and said means enabling relative movement between said latch means and said wall comprises a pivot pin supporting said latch handle for pivotal movement relative said wall.

9. The enclosure claimed in claim 8 in which said pin is supported on said wall for longitudinal movement relative said wall to enable disengagement of said latch means from said cover and said means biasing said cover includes a spring exerting a force eccentric to the axis of said pin for pivoting said latch means in one direction in response to the disengagement of said latch means from said cover for thereafter indicating the disengagement of said latch means from said cover.

10. In the enclosure claimed in claim 9, a sealing gasket carried by said cover engaged with an edge of said wall in response to the closure of said cover, and a projecting portion on said edge for penetrating said gasket to compress a portion of said gasket in accordance with the force exerted by said spring for limiting the deformation of other portions of said gasket engaged with said edge.

11. The circuit breaker enclosure claimed in claim 7 in which said circuit breaker has a pivotable circuit breaker handle reciprocally movable in sequence from a Reset position through an OFF position and a Trip position to an ON position to respectively enable the passage of current and prevent the passage of current through said breaker and moved to said Trip position in response to said fault current whereafter said handle requires movement to said Reset position to enable movement to said ON position and the passage of current through said breaker; the improvement comprising:

an enclosure handle, a pivot pin pivotally supporting said enclosure handle on said wall for pivotal movement to a respective position individually corresponding to said ON position, OFF position, Trip position and Reset position, and a breaker handle plate interconnecting said circuit breaker handle with said pivot pin for synchronously moving each handle to each handle position.

12. In the circuit breaker claimed in claim 11, an interlock plate pivotally supported on said wall;

and means pivoting said interlock plate to one position in response to said cover being in said open position for engaging said breaker handle plate to prevent movement of each of said handles to a respective ON position.

13. In the circuit breaker claimed in claim 12, means pivoting said interlock plate from said one position to another position in response to closure of said cover for enabling said enclosure handle to move to said ON position and thereafter controlled by said handle plate to prevent said cover from moving to said open position.

14. A circuit breaker enclosure including a peripheral wall encircling a circuit breaker adapted to be tripped in response to a fault current whereby a gas in said enclosure is subjected to relatively high pressure and is confined by said wall and a cover pivotally carried by said wall for movement between a closed position and an open position; the improvement comprising:

a latch handle having a latch spaced from one end of said handle for interlocking engagement with said cover to latch said cover in said closed position, means supporting said latch handle on said wall for pivotal and longitudinal movement relative said wall and relative said cover in said closed position for enabling said interlocking engagement and for enabling disengagement of said latch from said cover, and bias means for biasing said latch handle toward said one end for exerting a yieldable closing force on said cover in response to said interlocking engagement for enabling said cover to move toward said open position for venting said high pressure gas with said latch in interlocking engagement with said cover.

15. The enclosure claimed in claim 14 in which said cover has a sealing gasket for peripheral engagement with a free edge of said wall in response to the closure of said cover, and said wall has a projection on said free edge for compressing a local area of said gasket under a force dependent on said yieldable closing force.

16. The enclosure claimed in claim 15 in which said cover has a lip bent in one direction and said latch comprises a lip integrally formed on said handle and extending in a direction opposite said one direction in response to said cover being in said closed position.

17. The enclosure claimed in claim 16 in which said latch handle is U shaped and said means supporting said latch handle comprises a pivot pin passing through the side legs of said latch handle and an elongate passage of said wall for enabling pivotal and longitudinal movement of said latch handle.

18. The enclosure claimed in claim 16 in which said bias means comprises a helical spring located between said latch handle and said wall for exerting a force eccentric to the axis of said pin for pivoting said latch from said wall.

19. In the enclosure claimed in claim 15, a second latch handle with a latch means supporting said second latch handle for pivotal and longitudinal movement relative said wall at a position spaced from the first latch handle with a bias means biasing said second latch handle in a parallel direction; and a second projection on said free edge for compressing a second local area of said gasket with each projection spaced in correspondence with the respective latch.

20. A circuit breaker enclosure including a peripheral wall encircling a circuit breaker having a pivotable circuit breaker handle reciprocally movable in sequence from a Reset position through an OFF position and a Trip position to an ON position to respectively enable the passage of current and prevent the passage of current through said breaker and moved to said Trip position in response to a fault current whereafter said handle requires movement to said Reset position to enable movement to said ON position and the passage of current through said breaker, with said wall carrying a pivotable cover adapted to be pivoted to a closed position and from a closed position to an open position; the improvement comprising:

an enclosure handle, a pivot pin pivotally supporting said enclosure handle on said wall for pivotal movement to a respective position individually corresponding to said ON position, OFF position, Trip position and Reset position, a breaker handle plate detachably engaged with said circuit breaker handle and secured to said pivot pin for synchronously moving each handle to each handle position, an interlock plate pivotally supported on said wall, means pivoting said interlock plate to one position for engaging said breaker handle plate in response to said cover being in said open position to prevent movement of each of said handles to a respective ON position, means pivoting said interlock plate from said one position to another position in response to closure of said cover for enabling each of said handles to move to said ON position, interlock latch means on said interlock plate enabled to latch said cover in response to the closure of said cover and the pivoting of said interlock plate to said other position, and means on said handle plate for engagement with said interlock plate in response to the movement of said handles to respective ON position for controlling said interlock plate latch means to prevent said cover from moving from said closed position to said open position.

21. The improvement claimed in claim 20 in which said cover includes cover latch means moved to a position in said enclosure in response to the movement of said cover to said closed position and said latch means on said interlock plate is thereafter positioned in the path of said cover latch means in response to the pivoting of said interlock plate to said other position.

22. The improvement claimed in claim 21 in which said latch means on said interlock plate is integrally formed on said interlock plate.

23. In the improvement claimed in claim 20, means extending through said wall for enabling the pivotal movement of said interlock plate past said other position to move said interlock latch means from the path of said cover latch means.

24. In the improvement claimed in claim 23 means positioning said lever latch means in the path of said interlock latch means effective in response to pressure toward said wall applied to said cover in the closed position for enabling the pivotal movement of said interlock plate.

25. The improvement claimed in claim 20 in which said interlock plate is generally planar and said latch means on said interlock plate extends transverse to the general plane of said plate.

26. The improvement claimed in claim 25 in which said interlock plate is L shaped with one leg projecting from said enclosure in response to the opening of said cover and the other leg has a tang positioned in the path of said handle for engagement with said handle plate to restrain said handle plate against movement with said handles into a respective ON position.

27. The improvement claimed in claim 26 in which said tang is overlapped by said breaker handle plate in response to the movement of said interlock plate to said other position and the movement of said handles to a respective ON position for preventing pivotal movement of said interlock plate to said one position.

28. A circuit breaker enclosure including a peripheral wall encircling a circuit breaker having a pivotable circuit breaker handle reciprocally movable in sequence from a Reset position through an OFF position and a Trip position to an ON position to respectively enable the passage of current and prevent the passage of current through said breaker and moved to said Trip position in response to a fault current whereafter said handle requires movement to said Reset position to enable movement to said ON position and the passage of current through said breaker, with said wall carrying a pivotal enclosure handle and a pivotable cover adapted to be pivoted to a closed position and from a closed position to an open position; the improvement comprising:

a breaker handle plate detachably engaged with said circuit breaker handle and secured to said pivotal handle for movement with each handle to synchronously move one handle to a respective one of said positions in response to movement of the other handle, an interlock plate biased to one position in response to said cover being in said open position for preventing movement of said breaker handle plate past a predetermined position corresponding to said Trip position to prevent movement of each of said handles to a respective ON position, means moving said interlock plate from said one position in response to closure of said cover for enabling said handles to move to said ON position and for thereafter enabling control of the movement of said cover to an open position, and means on said handle plate for thereafter preventing movement of said interlock plate to said one position and for controlling said interlock plate to prevent said cover from moving to said open position.

29. In the improvement claimed in claim 22 in which said interlock plate is moved in response to said breaker handle moving from said ON position to said Trip position for engaging said breaker handle plate to prevent movement of said handles to said ON position.

30. The improvement claimed in claim 29 in which said interlock plate has an axis of rotation and a tang spaced from said axis of rotation with said tang having an edge transverse to a radial line from said axis of rotation and engaged by said breaker plate in response to movement of said breaker plate to said predetermined position and said cover being spaced from said closed position.

31. The improvement claimed in claim 30 in which said tang has a radial edge portion adapted to be engaged by said breaker plate in response to said handles being in said ON position for preventing movement of said interlock plate to said one position and movement of said cover to said open position.

32. The improvement claimed in claim 28 in which said cover has a cover latch element and said means enabling control of the movement of said cover comprises an interlock plate latch element integrally formed on said interlock plate for movement into the path of said cover latch element.

33. The improvement claimed in claim 32 in which said interlock plate latch element is moved from the path of movement of said cover interlock element in response to the movement of said cover from one closed position to a second closed position for enabling said cover to be opened with said handles in the ON position.

34. In the improvement claimed in claim 28, a sealing gasket carried by said cover for engaging an end edge of said wall, and a pair of spaced projections on said end edge of said wall for compressing said gasket under said pressure over an arc corresponding to the area of said projections for controlling the depth to which the remaining area of said end edge penetrates said gasket.

35. In the improvement claimed in claim 34, a lip on said cover, latch handle having a latch lip for interlocking engagement with said cover lip, means pivotally supporting said latch handle on said wall, means enabling said handle to move longitudinally along said wall, and bias means for biasing said latch handle and lip in one longitudinal direction relative said wall for exerting yieldable closing force through each lip on said cover for enabling venting of said gas while said latch lip is in interlocking engagement with said cover lip.

36. In the improvement claimed in claim 28, means movable with said enclosure handle to each handle position and movable relative said enclosure handle in said Reset position for enabling said enclosure handle to be latched in said Reset position.

37. The improvement claimed in claim 36 in which said enclosure handle comprises a lock plate having a stop thereon for engagement with a stop on said enclosure in said Reset position.

38. The improvement claimed in claim 37 in which said lock plate stop is held engaged with the enclosure stop by the spring toggle assembly of said circuit breaker.

39. The improvement claimed in claim 36 in which said means movable with said enclosure handle comprises a lock plate with a passage therein.

40. The improvement claimed in claim 28 in which said enclosure handle indicates the Trip position of said circuit breaker handle.

* * * * *